US006010382A

United States Patent [19]

Kennedy

[11] Patent Number: 6,010,382

[45] Date of Patent: Jan. 4, 2000

[54] HYDROPLANE INNER TUBE WITH ADJUSTABLE SEAT

[75] Inventor: Paul Kennedy, Shoreview, Minn.

[73] Assignee: Earth & Ocean Sports, Inc., Hyannis, Mass.

[21] Appl. No.: 09/299,055

[22] Filed: Apr. 23, 1999

[51] Int. Cl.[7] ..... B63B 1/00

[52] U.S. Cl. ..... 441/66; 441/67; 441/131

[58] Field of Search ..... 114/343, 345, 114/346, 363; 441/129–131; 297/284.2, 284.3, DIG. 6

[56] References Cited

U.S. PATENT DOCUMENTS

D. 287,528 12/1986 Maxwell et al. .
D. 305,449 1/1990 Rundquist, Jr. et al. .
D. 349,743 8/1994 Hare .
D. 384,720 10/1997 Spomer .
2,959,796 11/1960 Sander et al. ..... 441/131
4,451,239 5/1984 Hoenstine et al. .
4,552,539 11/1985 Hoenstine et al. .
4,635,581 1/1987 Scheurer .
4,708,676 11/1987 Lin .
5,046,978 9/1991 Howerton .
5,106,152 4/1992 Ward, Sr. et al. ..... 297/192
5,171,178 12/1992 Creek et al. .
5,279,510 1/1994 Remy .
5,295,885 3/1994 Karl .
5,360,360 11/1994 Peterson .
5,571,036 11/1996 Hannigan .
5,643,031 7/1997 Fenton et al. .
5,702,278 12/1997 Boucher .

*Primary Examiner*—Ed Swinehart
*Attorney, Agent, or Firm*—Richard P. Crowley

[57] ABSTRACT

An adjustable, seat-planar hydroplane apparatus of an inflatable, pneumatic inner tube with a central opening and a flexible cover encasing the tube and forming a smooth hydroplane bottom surface over the opening with an adjustable flexible strip detachably secured at the one, the other, or both ends, or in an intermediate overlap section which adjustably forms a top, taut plane surface, a draped seat in the opening, or may be removed and installed as desired.

15 Claims, 5 Drawing Sheets

HYDROPLANE INNER TUBE WITH ADJUSTABLE SEAT

BACKGROUND OF THE INVENTION

A hydroplane apparatus is an inflatable pneumatic or floatable inner tube with a flexible fabric cover and smooth bottom cover employed for recreational use.

Generally, such an apparatus is designed for free water use or to be towable behind water craft. In some cases these devices are designed for use on snow. A typical hydroplane apparatus is described in U.S. Pat. No. 4,451,239, issued May 29, 1984, and another in U.S. Pat. No. 4,552,539, issued Nov. 12, 1985.

Some hydroplane apparatuses or floatable tube devices employ a sling-type seat to permit a rider to sit within the central opening of the inner tube. U.S. Pat. No. 5,046,978, issued Sep. 10, 1991, describes a floatable tube device with an adjustable seat. An integral lateral band of flexible material, such as of nylon mesh, is securely affixed at the one and other end by stitching to opposing sides of the flexible fabric cover to act as a seat. A first and second belt member, one with a belt buckle, are secured to the bottom of the lateral band to permit adjustment of the seat within the central hole of the floatable tube device.

There are different manners of riding a hydroplane inner tube, such as by riding prone (flat on the rider's stomach), seated in the central opening, or kneeling. A flat-top inner tube with a fully covered top surface accommodates the prone rider or the kneeling rider, but not the seated rider. An open-top hydroplane with exposed center hole accommodates the seated rider or kneeling rider, but not the prone rider. Thus, it is desirable to provide a hydroplane apparatus with an adjustable strip material to form a planar surface over the top, an adjustable seat or, optionally, capable of being easily installed, removed, or adjusted. Such an apparatus would accommodate seated, kneeling, and prone riders alike.

SUMMARY OF THE INVENTION

The invention comprises a hydroplane apparatus and, in particular, a hydroplane apparatus with an easily adjustable strip material to form a top planar surface or an adjustable seat or adapted to be easily removed.

The invention comprises an adjustable, seat-planar apparatus which comprises a floatable inner tube element having a central opening extending there through within the inner diameter and having a top surface, a bottom surface, and peripheral inner and outer sides; and a flexible tube cover encasing the outer sides and the top surface and extending over the bottom surface to form a hydroplane bottom surface which covers the central opening. The apparatus includes a flexible transverse sheet material strip adapted to support a rider thereon with a width less than the inner diameter and a length sufficient to extend transversely to directly opposing top surfaces and having a one end and another end and an intermediate section; and an adjustable, releasable, fastening means secured to the one end, the other end, both ends, or to overlapping intermediate ends and to an opposing, transverse top surface or the cover. The fastening means provides for the fastening of the one end, the other end, or both ends to the top surface or between the overlapping intermediate ends to provide for rider adjustment of the length of the strap across the inner diameter between a taut, prone position planar to the opposing top surfaces of the cover to permit a prone riding positioning of a rider, and a draped seat position wherein the strip is fastened to the opposing top surfaces of the cover and extends below the top surface within the inner diameter to form an adjustable seat for a rider, and a nonuse position wherein the strip is removable from the apparatus or not used by a rider.

The detachable fastening means employed may include, but not be limited to: zippers; male and female opposing snaps; belts and buckles; or preferably, opposing hook and loop-type fasteners, such as VELCRO® fabric strips which, when pressed together, interlock and detachably secure the strip material in the selected desired position. Usually, the VELCRO®-type fastener material is a fabric material which is secured by an adhesive or sewn to the strip. Where the hook and loop fasteners are employed, a sufficient surface area of the fastener should be selected to be secured to provide sufficient support for the rider in the prone or seated position and yet be easily and rapidly removed or readjusted by the rider.

The inner tube element may be any floatable-type material or any selected outer shape, such as a circular or triangular shape, but generally is an inflatable, pneumatic, inner tube with a central opening, for example, a circular, triangular, or other shaped opening. Where a circular opening is used, the tube may have a diameter of about 56 to 60 inches outside diameter with a 22 to 24 inch inner, circular opening.

The hydroplane apparatus includes the inner tube, which is encased in a flexible fabric cover, such as a heavy nylon material, optionally impregnated, treated, or coated with a plastic material, such as a polyurethane. The cover forms a smooth fabric bottom surface over the central opening of the inner tube and extends about all the peripheral sides and over the top of the inner tube. The cover may be lengthly fitted, retained, and removable by the use of a cover zipper. The cover may, for example, be an 800 to 1000 denier, woven nylon cover coated with a polyurethane.

The hydroplane apparatus may include a tow attachment, such as a tow strip, extending from the cover to permit the hydroplane apparatus to be towed in use by a motorboat, or a hook-like element extending from an exterior side of the hydroplane apparatus. The hydroplane apparatus also may include one or more handles for grasping by the rider in use. The handles, typically of plastic or fabric, extend upwardly from and about the top surface of the inner tube cover.

The strip material employed should be a flexible material which is sufficient to support a rider and generally comprises a woven-type fabric, such as material the same as or similar to the cover material, like a nylon, aromatic polyamide, or polyester fabric material; however, a wide variety of flexible fabrics may be used.

The strip material may be coated, covered, or laminated to one or more layers of other material, such as elastomeric flexible sheet material, like neoprene rubber to prevent slippage of a rider, and particularly, in the area where the fastening means are employed to impart greater strength to the strip material.

In one embodiment, the strip may comprise a unitary, integral, flexible strip material of selected width (usually less than the inner diameter of the opening) and of selected length (usually slightly greater than the inner diameter of the inner tube and usually about the length of the outer diameter of the tube) to provide sufficient strip length to form a taut, prone riding platform across the top planar surface of the inner tube and to provide a selected draped seat extending from the top cover surface and within the inner diameter.

Where the strip is a unitary strip, one end, the other end, or both ends may be secured to the top surface cover by the fastening means, so that the strip may be easily installed or removed by a rider where both ends are detachably fastened. One end or the other end of the transverse strip may be fixedly secured, such as by adhesives or stitching to the top surface cover, with the one end or the other end detachably fastened to the opposite top surface cover. The strip may be rolled up and placed to one side in the inner diameter when not in use.

In use, the strip is adjustably extended in a taut position over the top surface of the inner tube to form a planar cover for use by a prone rider.

In use, the strip may be adjustably fastened and draped within the inner diameter of the inner tube to form a sling seat of selected slack or position within the central opening for the rider.

In another embodiment, the strip may form two separate strip sections which overlap in the middle, and wherein the intermediate ends at the middle have a fastening means to permit the interlocking of the overlapped ends in a sling seat or taut prone position. In this embodiment, the one and other ends of each strip section may be fixedly secured to the top surface cover or be detachably secured by the fastening means, so that each intermediate section has a detachable fastening means.

Thus, the hydroplane apparatus of the invention permits easy and rapid adjustment of the strip material or removal thereof. Thus, providing for versatility in the use by accommodating seated, kneeling, and prone riders.

The invention will be described for the purpose of illustration only in connection with certain illustrated embodiments; however, it is recognized that various changes, modifications, additions and improvements may be made in the illustrative embodiments without departing from the spirit or scope of the invention.

DESCRIPTION OF THE EMBODIMENTS

Figure 1:
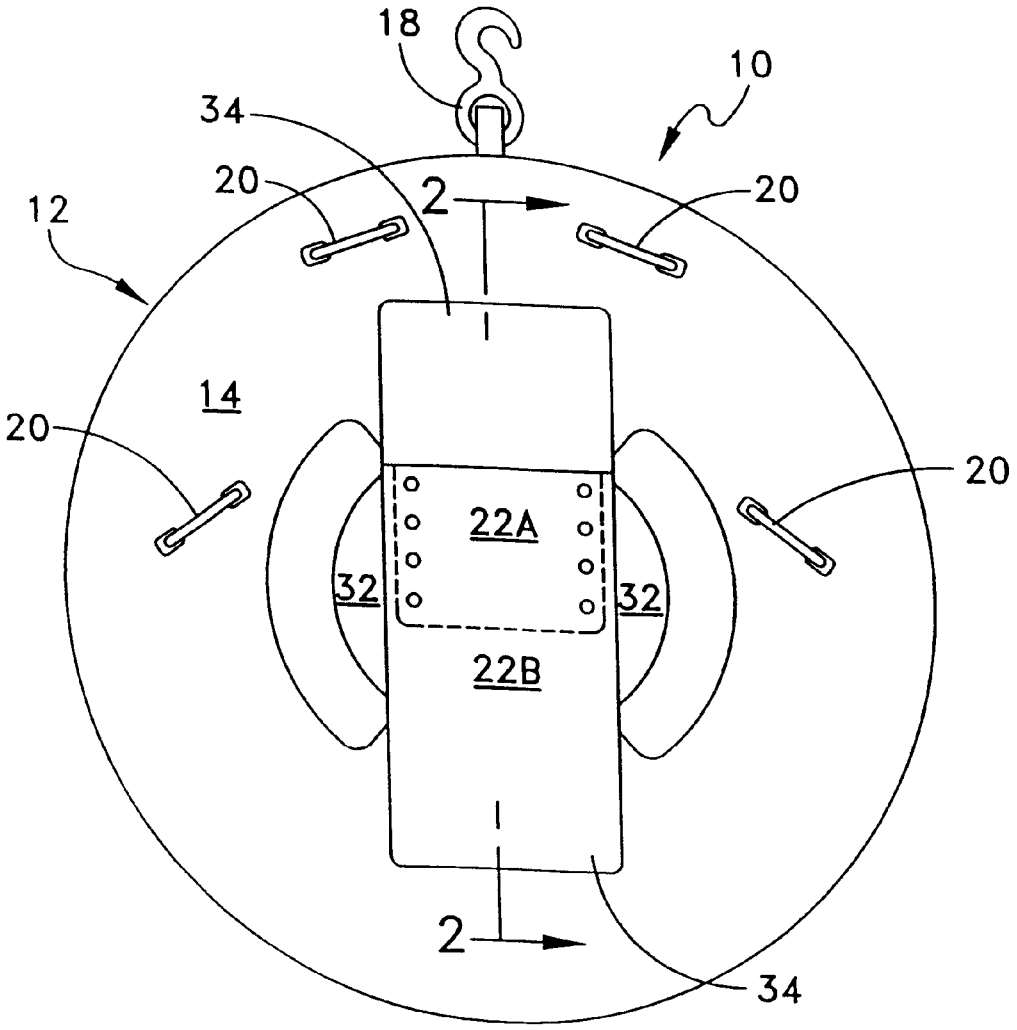
FIG. 1 is a schematic, illustrative, top plane view of one embodiment of the hydroplane apparatus of the invention.

FIG. 1 shows a hydroplane apparatus 10 comprising a pneumatic, inflatable, polyvinyl chloride (PVC) (30 gauge) or a HYPALON™ (a trademark of DuPont for a chlorosulfonated polyethylene, a synthetic rubber), or other rubber material inner tube 12 with a 54 inch diameter, encased within a flexible, polyurethane-coated, 840 denier nylon cover 14 with a circular central opening 16 about 22½ inch diameter 30.

The apparatus 10 includes a tow hook 18 for towing by a motorboat and web or foam handles 20. The strips of a 1000 denier nylon, polyurethane-coated, flexible fabric with a width of 12 to 14 inches 22A and 22B extend transversely across central opening 16 and the end of each strip 22A and 22B is fixedly stitched to the upper portion of the top surface cover 34.

Strips 22A and 22B overlap to form an intermediate detachable section 36. The intermediate ends of free strips 22A and 22B have a neoprene layer 24 on the respective top surfaces of the strips 22A and 22B, which composite nylon-neoprene layer forms the prone or seat section of the strips 22A and 22B.

The hydroplane has a continuous bottom surface 32 of the cover 14 to provide a smooth hydroplane surface for the apparatus 10 and to cover over the bottom of central opening 16. The free overlapped ends, about 6–12" in length, include a plurality of detachable, opposing male 26 and female 28 transversely aligned snaps (or optional VELCRO® hook and loop fabric), so that the length of the strips 22A and 22B may be easily adjusted by the closure of the snaps 26 and 28.

The one end and the other end of strips 22A and 22B may be straight edges or arcuate and secured or fit on the top or on an upper, curved top surface of the cover 14.

Figure 2:
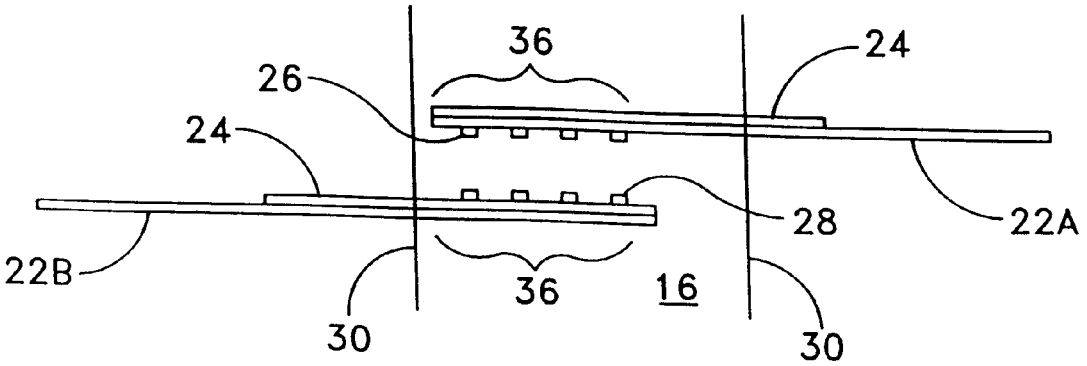
FIG. 2 is an enlarged, fragmentary, plan side view along side 2—2 of FIG. 1.

FIG. 2 substantially illustrates the overlapping strips 22A and 22B with opposing snaps 26 and 28 in position, to be fastened to provide a taut, planar strip surface over the top planar surface of the inner tube 12.

Figure 3:
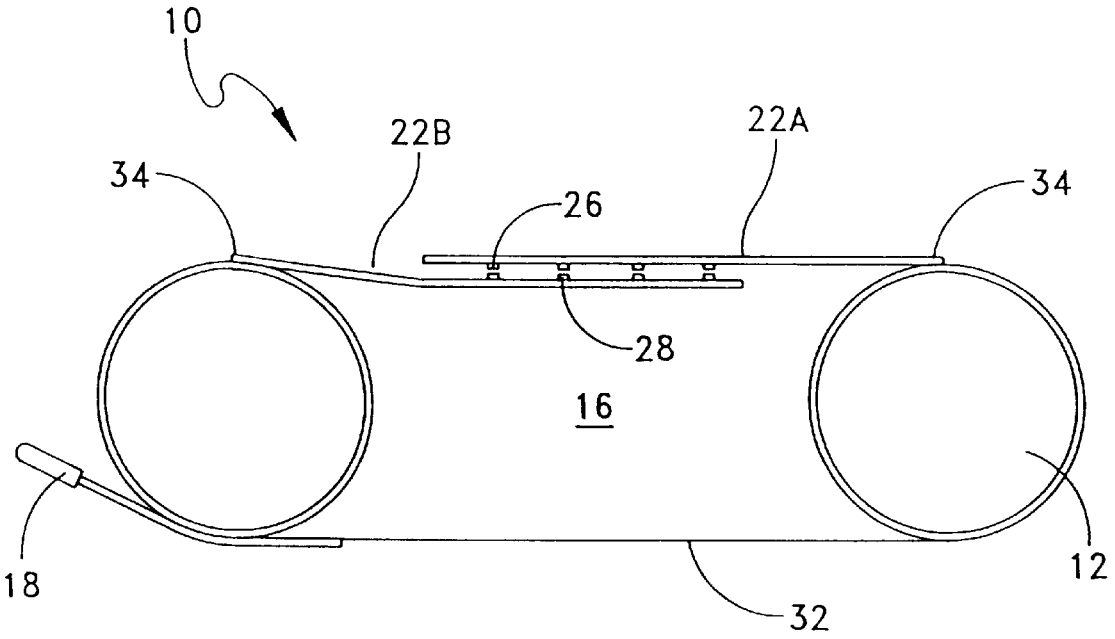
FIG. 3 is a cross-sectional view along line 3—3 of FIG. 1 illustrating the strip in the taut position for a prone rider.

FIG. 3 illustrates schematically the strips 22A and 22B as snapped together to provide a taut, prone rider position.

Figure 4:
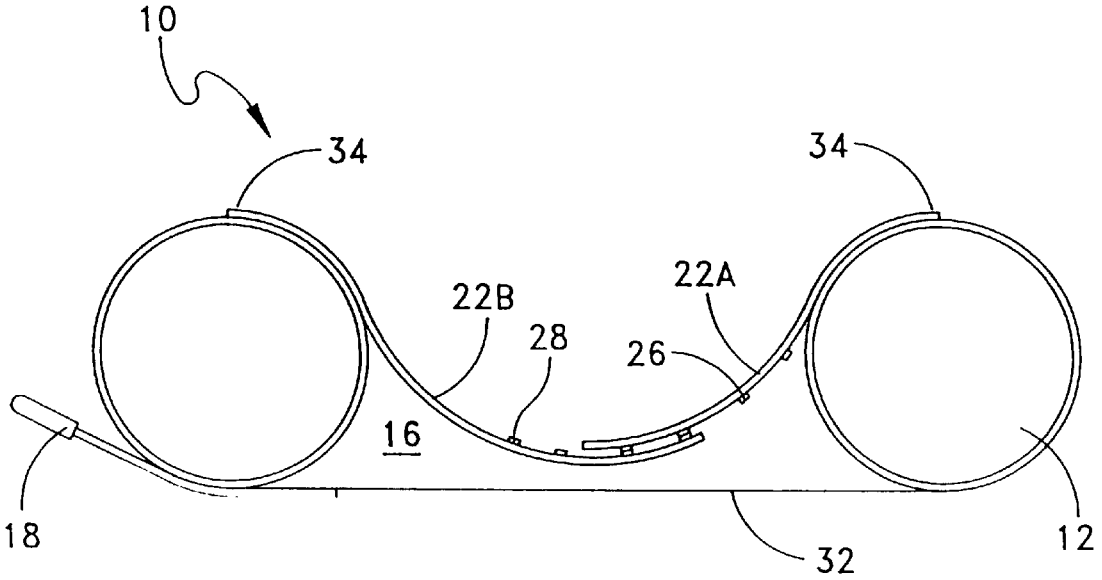
FIG. 4 is a cross-sectional view along line 3—3 of FIG. 1 illustrating the strap in a draped position for a vertical rider.

FIG. 4 illustrates schematically the strips 22A and 22B with the snaps 26 and 28 in a different position to loosen the length of strips 22A and 22B to form a sling seat for the rider.

Figure 5:
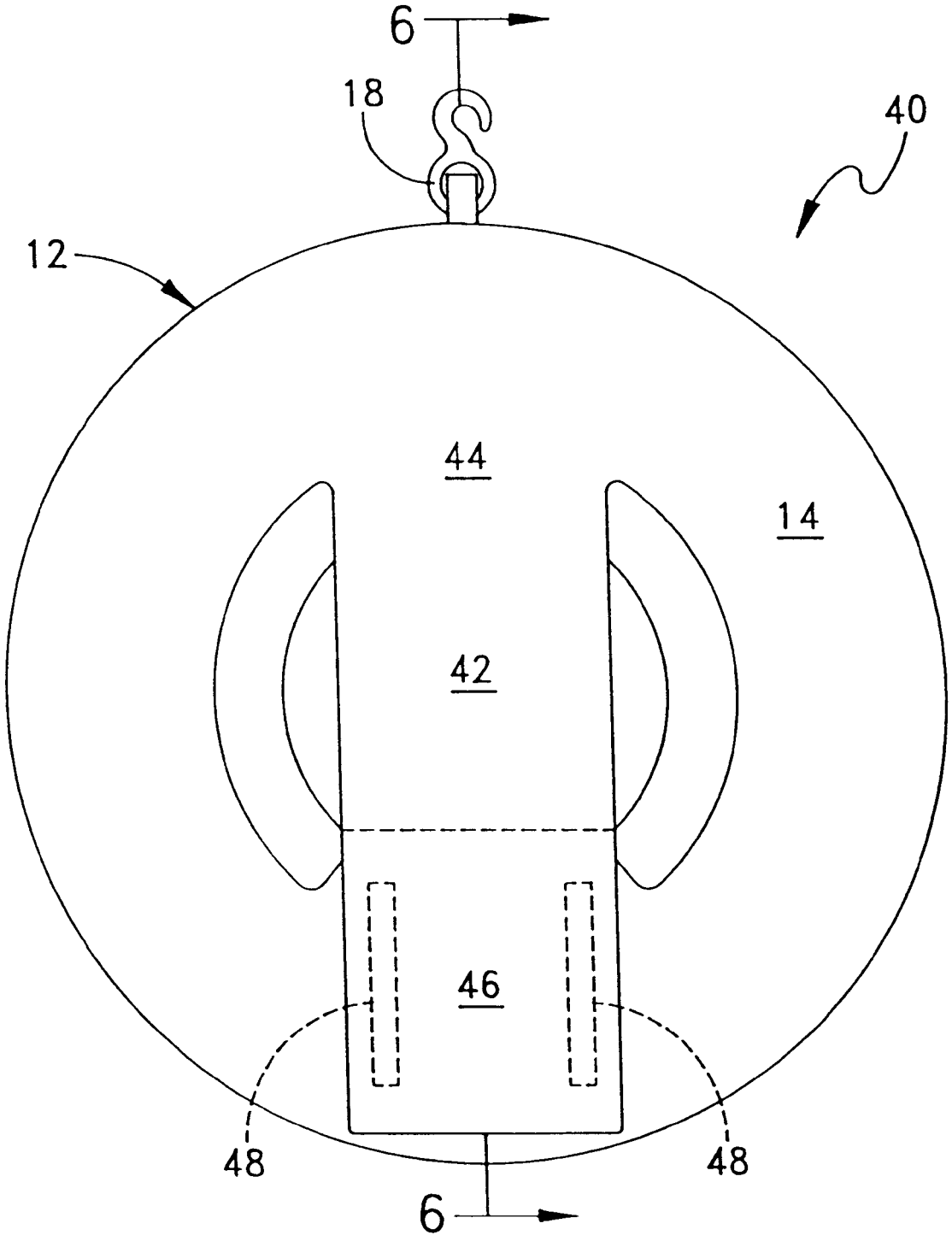
FIG. 5 is a schematic illustration of a top plan view of another embodiment of the hydroplane apparatus of the invention.

FIG. 5 shows another embodiment of a hydroplane apparatus 40 of the invention with a cover 14 across the central opening 16 and having an integral, continuous, elongated band or strip 42 to act as an adjustable seat or prone cover.

The strip 42 is fixedly attached at one end 44 to the cover, such as by adhesives or stitching to the top surface cover or as an integral woven part thereof. The other end 46 extends to the opposite, top surface cover of the inner tube and is detachably and adjustably secured by opposing strips of VELCRO® fabric material 48. The fastening VELCRO® strips extend generally parallel on either side and are spaced apart and extend over the arcuate top surface of the cover a sufficient length to permit the desired adjustment of the strip 42. The strip 42, e.g., of woven nylon extends generally over the arcuate top surface of the inner tube, a defined distance, to permit lengthwise adjustment as desired.

Figure 6:
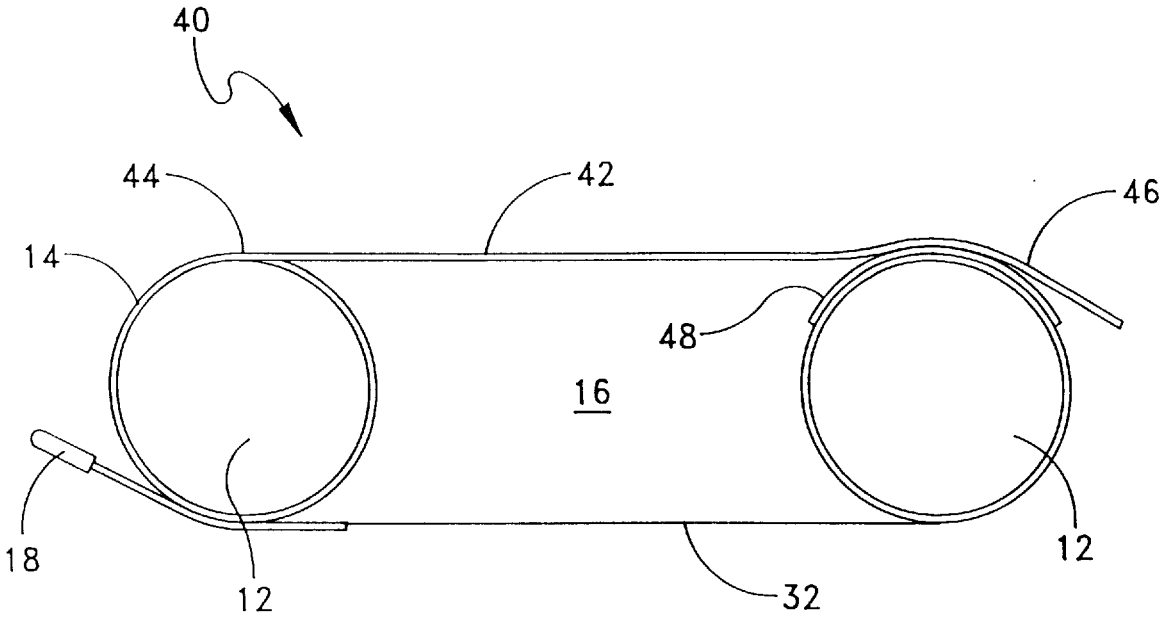
FIG. 6 is a cross-sectional view along line 6—6 of FIG. 5 illustrating the strip in a taut position for a prone rider.

FIG. 6 shows the sectional view of the hydroplane apparatus 40 with the strip 42 in the taut, prone rider position.

Figure 7:
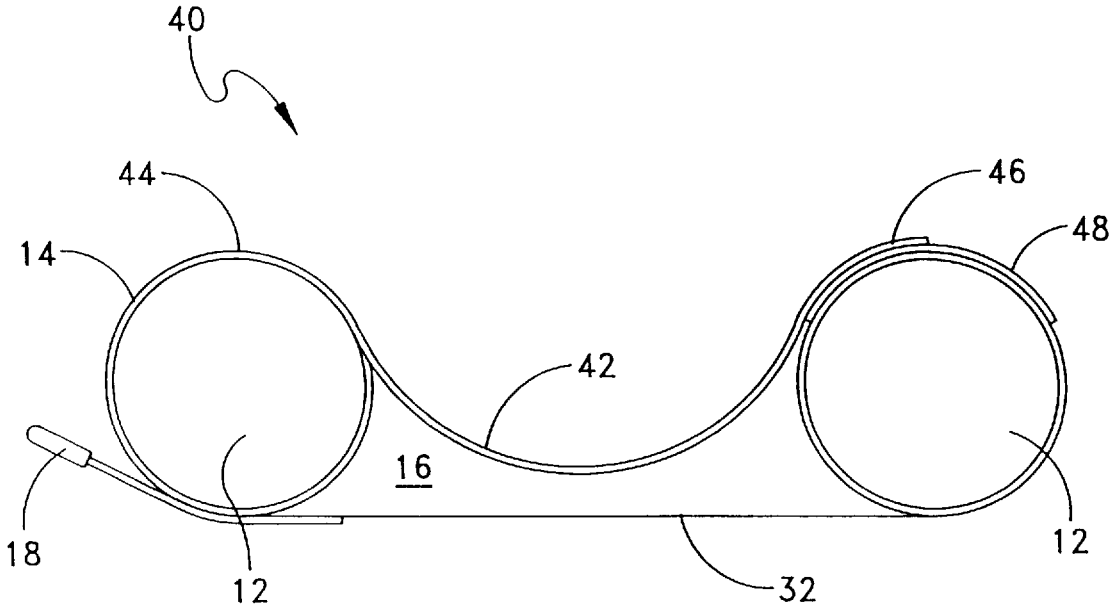
FIG. 7 is a cross-sectional view along lines 6—6 of FIG. 5 illustrating the strip in a draped position for a seated rider.

FIG. 7 shows the sectional view of the hydroplane apparatus 40 with the strip 42 in the draped rider-rest position.

Figure 8:
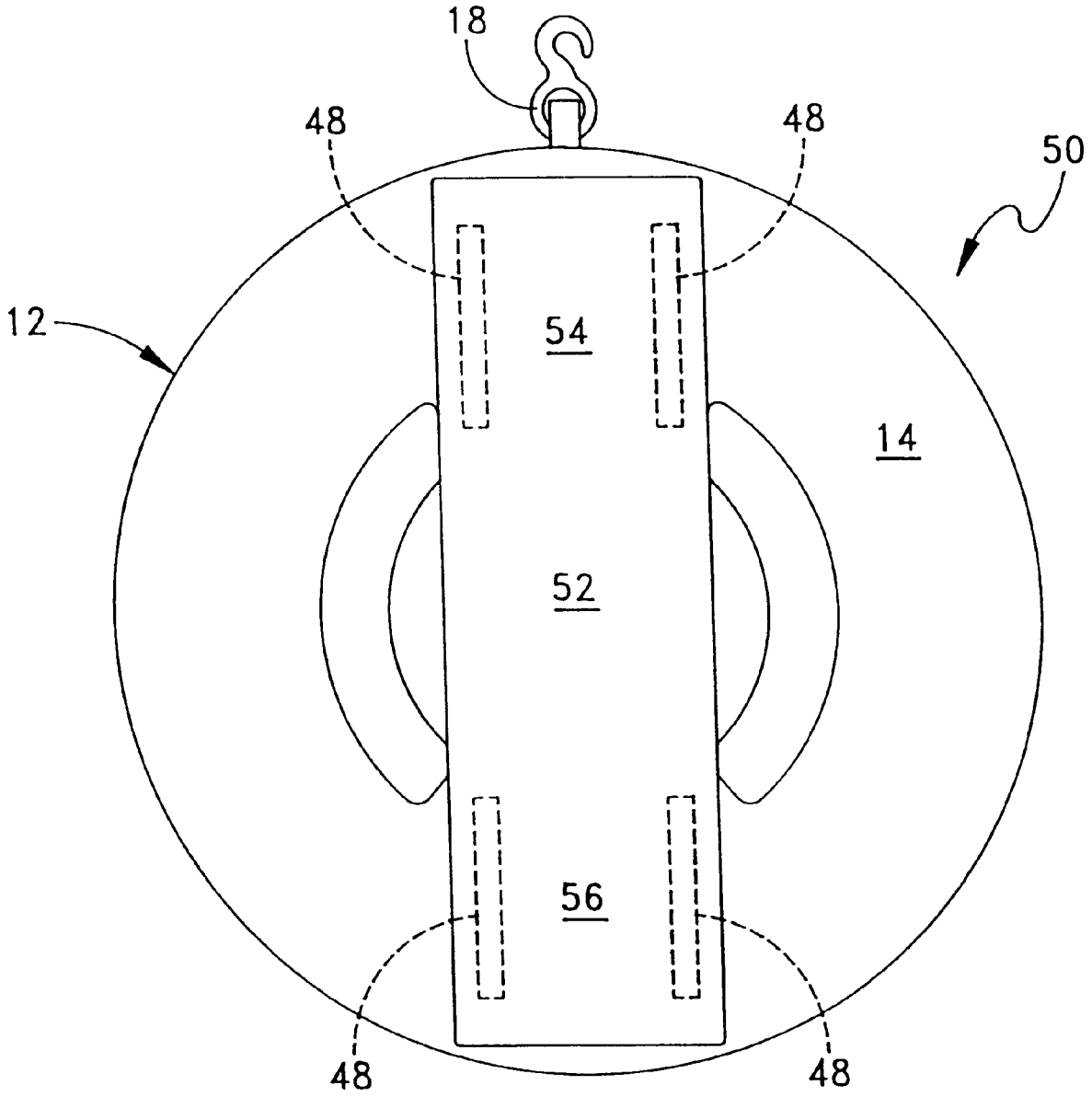
FIG. 8 is a schematic illustration of a top plan view of a further embodiment of the hydroplane apparatus of the invention.

FIG. 8 shows a further hydroplane apparatus embodiment 50, wherein a continuous band or strip material 52 extends across the central opening 16 of the inner tube 12 with the encasement cover 14. Opposing top surface cover 14 and the underside ends of the strip 52 at ends 54 and 56 include parallel, spaced-apart, VELCRO® fabric material strips to detachably secure the strip material 52 in place and yet permit a rider or others to adjust rapidly and easily (or to remove entirely) the strip 52 for prone or seat use by altering the one end 54, the other end 56, or both ends 54 and 56 on the exterior surface of the top cover to provide a versatile hydroplane apparatus.

While the hydroplane apparatus has been described and illustrated with a smooth, coated, fabric bottom surface to cover the central opening, it is recognized that the bottom surface may be omitted and the adjustable prone-seat used for other recreational use.

What is claimed is:

1. An adjustable seat-planar apparatus which comprises:

a) a floatable inner tube element having a central opening extending there through with an inner diameter and having a top surface, a bottom surface, and peripheral inner and outer sides;

b) a flexible tube cover encasing the outer sides and the top surface and extending over the bottom surface to form a hydroplane bottom surface which covers the central opening;

c) a flexible, transverse, sheet material strip adapted to support a rider thereon with a width less than the inner diameter, a length sufficient to extend transversely to directly opposing top surfaces, and having a one end, another end, and an intermediate section; and d) an adjustable, releasable, fastening means secured to the one end, the other end, both ends, or to overlapping intermediate ends and to opposing, transverse, top surfaces of the cover to provide for the fastening of the one end, the other end, or both ends to the top surface or between the overlapping intermediate ends to provide for rider adjustment of the length of the strip across the inner diameter between:

i) a taut prone position planar to the opposing top surfaces of the cover to permit a prone riding positioning of a rider;

ii) a draped seat position wherein the strip is fastened to the opposing top surfaces of the cover and extends below the top surface, within the inner diameter, to form an adjustable seat for a rider; and iii) a nonuse position wherein the strip is removable from the apparatus or not used by a rider.

2. The apparatus of claim 1 wherein one end, the other end, or both ends are securely, nondetachably fastened to the transverse, opposing top surfaces of the cover, and the intermediate section has slightly overlapping ends which are adjustably, releasably fastened by the fastening means.

3. The apparatus of claim 1 wherein the fastening means comprises a hook and loop fabric whose opposing surfaces are detachably fastened and fastenable.

4. The apparatus of claim 1 wherein the strip comprises an integral strip material, and one end and the other end of the strip are adjustably releasably fastened to the top surface of the cover, whereby the strip is adjusted at either the one, or the other end, or both ends to the selected position.

5. The apparatus of claim 1 wherein the one end and the other end are stitchably secured to the top cover surface, and the strip includes opposing, central, overlapping strip ends, the overlapping strip ends having opposing hook and loop fastening means.

6. The apparatus of claim 1 wherein the inner tube element comprises a circular pneumatic, inflatable inner tube with a circular central opening.

7. The apparatus of claim 1 wherein the top cover comprises a woven flexible fabric.

8. The apparatus of claim 1 wherein the fastening means comprises opposing male and female snaps.

9. The apparatus of claim 1 wherein the intermediate ends of the intermediate section overlap with fastening means on opposing overlapping surfaces.

10. The apparatus of claim 1 wherein the intermediate ends of the intermediate section overlap a length of about 30 to 60 percent of the inner diameter.

11. The apparatus of claim 1 wherein the one end is stitchably secured to the top surface cover, and the other end has an adjustable, releasable fastening means fastened to the transverse opposing top cover, and the strap comprises an integral sheet material strip.

12. The apparatus of claim 1 wherein the strip material comprises a prone-seat section of a woven flexible fabric and a layer of a flexible, polymeric sheet material.

13. The apparatus of claim 12 wherein the polymeric sheet material comprises an elastomeric sheet material.

14. The apparatus of claim 12 wherein the strip material comprises one end and other end stitchably secured to the top cover surface and which strip material has overlapping intermediate ends, the overlapping ends comprising a prone-seat section and wherein the fastening means are on opposing overlapping surfaces of the overlapping intermediate ends.

15. The apparatus of claim 14 wherein the fastening means comprises a hook and loop fabric whose opposing surfaces are detachably fastened and fastenable.

* * * * *